US006578273B1

(12) United States Patent
Eickhorn

(10) Patent No.: US 6,578,273 B1
(45) Date of Patent: Jun. 17, 2003

(54) KNIFE WITH RECESSES IN BLADE

(76) Inventor: Jörg Eickhorn, Brend'smour Str. 21, D-40545 Düsseldorf (DE)

( * ) Notice: Subject to any disclaimer, the term of this patent is extended or adjusted under 35 U.S.C. 154(b) by 0 days.

(21) Appl. No.: 09/709,244

(22) Filed: Nov. 9, 2000

(30) Foreign Application Priority Data

Jun. 6, 2000 (DE) ..... 200 09 958 U

(51) Int. Cl.[7] ..... B26B 9/02
(52) U.S. Cl. ..... 30/355; 30/357
(58) Field of Search ..... 30/355, 356, 357; D6/649, 650

(56) References Cited

U.S. PATENT DOCUMENTS 714,359 A * 11/1902 Brooks ..... 30/357
1,227,234 A * 5/1917 Bacon ..... 30/355
1,723,843 A * 8/1929 Chapin ..... 30/355
1,728,192 A * 9/1929 Wellington ..... 30/355
2,059,414 A * 11/1936 Taylor ..... 30/355
2,753,632 A * 7/1956 Varn ..... 30/355
3,574,937 A * 4/1971 Wolfe ..... 30/355

FOREIGN PATENT DOCUMENTS

AU 206526 * 11/1954
CH 133535 * 6/1929

* cited by examiner

*Primary Examiner*—Hwei-Siu Payer
(74) *Attorney, Agent, or Firm*—Schweitzer Cornman Gross & Bondell LLP

(57) ABSTRACT

A knife has a blade with a cutting edge and a plurality of recesses in the cutting edge. The recesses are in the form of incisions and the space between adjacent recesses is substantially greater than the width of the incisions. The recesses are aligned at acute angles and right angles with respect to the cutting edge.

5 Claims, 1 Drawing Sheet

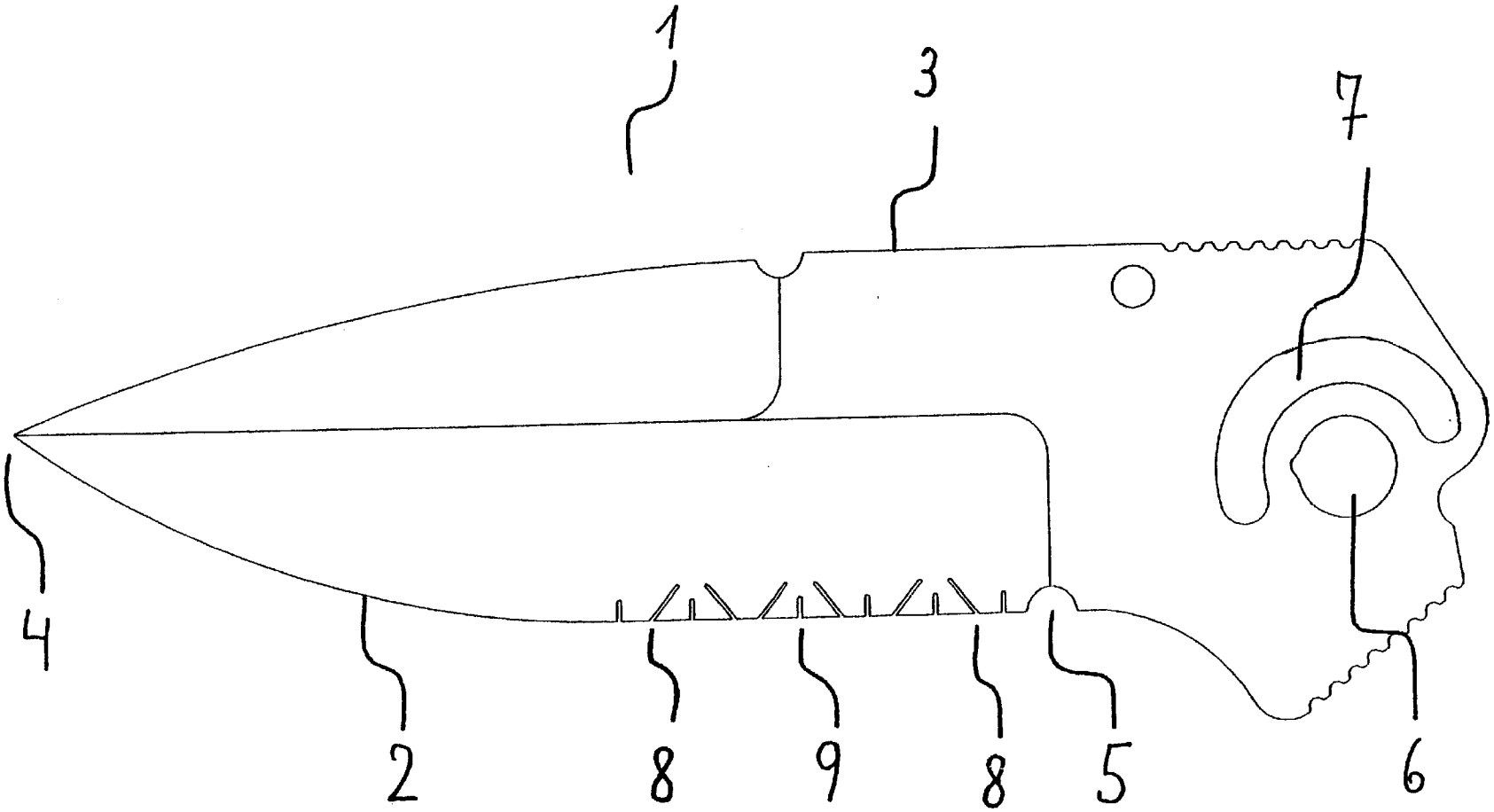
1
2
3
4
5
6
7
8
8
9

KNIFE WITH RECESSES IN BLADE

DESCRIPTION

The invention concerns a blade of a cutting tool such as for example a knife or a saw. This may involve for example the blade of a folding knife or jack-knife. The blade can also be fixedly connected to a knife handle.

A conventional knife blade has a cutting edge, by virtue of which a blade is in a position to serve as a cutting tool. For example, the cutting edge extends substantially rectilinearly. It is only at the open, generally pointedly converging end of the blade, that the cutting edge is in the shape of an arc.

A cutting edge which is of the above-indicated shape does not act in every case as a good cutting tool. Thus, the shape of the cutting edge is for example entirely or partially of an undulating or wavy configuration if the knife is intended for example to be a so-called bread knife. The cutting edge in the case of a bread knife generally involves a so-called undulating or wavy grind. In that case, the cutting edge does not extend straight but in a wavy or undulating configuration. The wavy or undulating shape provides that, in the cutting operation, the blade acts in part like a saw. The cutting edge digs into the article, which for example is a loaf of bread, and in part tears it apart. The operation of cutting off a slice of bread is therefore based both on a cutting effect and also on a tearing effect.

A wavy or undulating grind on a blade suffers in particular from the disadvantage that it cannot be re-ground in conventional manner. In order to re-grind a wavy or undulating grind, a special tool is required, which is generally not available to the average user.

The object of the invention is to provide a blade for a knife, which on the one hand can be re-sharpened in conventional manner for example by a whet steel or a normal grindstone and which on the other hand has cutting properties like a blade with a wavy or undulating grind.

The blade includes a cutting edge which, unlike the wavy or undulating grind, is substantially more like the conventional shape discussed in the opening part of this specification. The cutting edge is therefore distinguished by a for example straight configuration. Towards the open end of the blade the cutting edge extends for example arcuately. The cutting edge according to the invention differs from the state of the art however by openings or recesses which can be in the form of incisions or slits. The overall width of the recesses is made up of the individual widths of the recesses. The term width of a recess is used to denote the width of the recess at the cutting edge. If therefore the width of the recess increases with depth, then the width is to be considered at the beginning of the recess. In comparison with the length of the blade (measured from the blade tip to the location from which a handle is provided), the overall width is substantially smaller. No grind, that is to say no sharp edge, must be provided in the interior of the recesses.

A blade with a wavy or undulating grind which extends over the entire length of the cutting edge differs from the inventive blade by virtue of the following features.

If the spacing from one wave peak to the next is interpreted as the overall width of the recess disposed therebetween, in the form of a wave trough, then the overall width of those recesses is of a similar magnitude to the length of the blade, measured from the blade tip to the location at which the handle is provided. In addition the wave troughs are also ground in such a way that there are also sharp edges (the cutting edge of a blade) in the wave troughs.

The recesses provide that, when cutting an article, it comes into hooking engagement at the recesses and thus there is a tearing effect, as in the case of a knife with a wavy or undulating cutting edge. As the external shape of the cutting edge is substantially the same as the conventional one, it can be easily re-ground with conventional grinding tools such as for example a whet steel. Unlike a knife with a wavy or undulating grind there is no need for the edge which occurs between two peaks of the undulating configuration also to be ground. Thus on the one hand this blade has the properties of a blade with an undulating or wavy grind. On the other hand it can be ground using simple means.

In an advantageous configuration the transition from the cutting edge which is ground sharp into the recess extends in an angular configuration. That transition therefore does not involve the shape of an arc, as is the case with a blade with an undulating or wavy grind. It has been found that then the article to be cut is better subjected to a hooking engagement effect. The tearing effect is increased in that way. Yielding articles such as for example a loaf of bread can be more easily cut up, in comparison with using a knife with a wavy or undulating grind.

The depth of a recess can be limited to a few millimeters. Depths of a few tenths of a millimeters may even suffice. In an embodiment the depth of a recess is for example two millimeters.

In an embodiment the width of a recess is 1/10th of a millimeter. The width can therefore be very small. It is however also possible for the width of a recess to be of the order of magnitude of one or more millimeters.

The above-indicated dimensions relate to blades as are used in a domestic knife or a pocket knife.

The spacing between two recesses is large in relation to the width of a recess. In an embodiment the spacing between two recesses is at least ten times as great as the width of an recess. If the width of a recess is 1/10th of a millimeter, then the spacing between two recesses can be two millimeters and more. The term spacing between two recesses is used to denote the spacing of two adjacent 'cutting edge-recess' transitions of those two recesses.

As the spacing between two recesses is substantially greater than the width of a recess, the shape of a conventional cutting edge of a knife blade is substantially retained. The above-defined overall length of the blade is then also substantially greater than the overall width of the recesses.

Preferably, the recesses are in the form of slits or incisions. The slits or incisions can be produced particularly easily by a cutting operation.

In particular the incisions are regularly distributed along the rectilinearly extending part of the cutting edge. That region is primarily used for cutting up articles so that the incisions are then also to be disposed here.

Slits or incisions can extend perpendicularly with respect to the cutting edge or inclinedly with respect thereto. If the slits extend inclinedly with respect to the cutting edge, there is an acute angle which forms the transition from the cutting edge to the recess. If the blade moves in the direction of the acute angle, a yielding article is particularly easily involved in hooking engagement therewith. The effect of the tearing action is further enhanced in that way. Articles such as loaves of bread can then be still more easily cut up.

Preferably the direction of inclinedly extending incisions changes in such a way that the above-mentioned acute angle at the 'recess-cutting edge' transition faces now away from the open end of the blade and now towards the open end of the blade.

As discussed above, the blade as claimed is particularly effective in terms of its action if an acute angle is provided as the transition between a recess and the cutting edge, and the blade is moved during the cutting operation in the direction of that acute angle. If the direction in which the above-mentioned acute angles face alternates, then the article to be cut up is caught in any case independently of the cutting direction at such an acute transition between the cutting edge and the recess. The desired effect is thus further improved.

EMBODIMENT

A preferred embodiment of the invention will be apparent with reference to the FIGURE.

The blade 1 has a sharp-ground edge 2 and a blunt, oppositely disposed edge 3. The sharp-ground edge 2 represents the cutting edge. The cutting edge extends from the tip 4 of the blade to the location 5. From the location 5, the region of the blade serves for fixing a handle. That region has a hole 6 through which a pin can be passed, in the interior of a knife handle. The arcuately extending slot 7 serves as a guide as the blade shown in the Figure is a blade for a folding knife. From the position 5 in the direction of the tip 4 the cutting edge firstly extends substantially rectilinearly. Towards the pointed end 4 the shape of the cutting edge goes into an arc and finally terminates at the blade tip.

Inclinedly extending incisions 8 are provided at regular spacings in the rectilinearly extending part of the cutting edge 2. The direction of the inclinations alternate in such a way that the transitions, which extend in a pointed configuration, between an incision 8 and the cutting edge 2 face alternately in one direction and in the opposite direction. The depth of the incisions 8 is two millimeters. The width of an incision 8 is 1/10th of a millimeter. The inclinations are such that they include acute angles of 45°, to the cutting edge. Incisions 9 which extend perpendicularly to the cutting edge are provided between inclinedly extending incisions 8. The incisions 9 are somewhat shorter in comparison with the inclinedly extending incisions 8. In that way, many incisions of which at least some extend inclinedly can be provided on a relatively short length at regular spacings relative to each other. Overall, in the illustrated example, twelve incisions 8 and 9 respectively are distributed over a length of 3.5 cm.

It will be appreciated that the above-indicated dimensions only represent examples. The only essential consideration is that the width of the incisions 8 and 9 respectively is small in relation to the spacings between two incisions so that in that way the conventional shape of the cutting edge of a blade is retained. It is then possible without any problem to re-grind those blades.

What is claimed is:

1. A knife comprising a blade having a cutting edge and a plurality of recesses in the cutting edge, wherein the recesses are in the form of incisions;

wherein a spacing between two adjacent recesses is substantially greater than a width of the incisions;

wherein the recesses are such that acute angles as well as right angles are present at the transition from the cutting edge to the recesses.

2. A knife according to claim 1 in which the acute angles which form the transition between the cutting edge and the recesses include some facing in one direction and some facing in the opposite direction.

3. A knife according to claim 1 comprising at least five recesses.

4. A knife according to claim 1 wherein inclinedly extending incisions are provided at the recesses and said recesses are formed at acute angles of between 30° and 60° with the cutting edge.

5. A knife according to claim 1 wherein the spacing between two recesses is at least five times greater than the width of the recess.

* * * * *